US007662115B2

(12) United States Patent
Leismer

(10) Patent No.: US 7,662,115 B2
(45) Date of Patent: Feb. 16, 2010

(54) MUSCULOSKELETAL LOADING DEVICE

(76) Inventor: Jeffrey M. Leismer, 999 SW. 16th Ave., #98, Gainesville, FL (US) 32601

( * ) Notice: Subject to any disclaimer, the term of this patent is extended or adjusted under 35 U.S.C. 154(b) by 0 days.

(21) Appl. No.: 11/433,988

(22) Filed: May 15, 2006

(65) Prior Publication Data

US 2006/0217639 A1 Sep. 28, 2006

Related U.S. Application Data

(63) Continuation of application No. 10/419,005, filed on Apr. 18, 2003, now abandoned.

(60) Provisional application No. 60/373,546, filed on Apr. 18, 2002.

(51) Int. Cl.
*A61H 1/00* (2006.01)
*A61H 7/00* (2006.01)

(52) U.S. Cl. ..... 601/49; 601/70; 601/79; 601/133

(58) Field of Classification Search ..... 601/46, 601/49, 70, 78, 79, 133; 602/20, 23, 25, 602/32, 36; 606/57, 58
See application file for complete search history.

(56) References Cited

U.S. PATENT DOCUMENTS 2,114,322 A * 4/1938 Shafer ..... 602/25
3,550,585 A 12/1970 Howard
4,055,169 A * 10/1977 Baker et al. ..... 601/46
4,846,461 A * 7/1989 Robards et al. ..... 482/72
5,052,378 A * 10/1991 Chitwood ..... 606/242
5,098,040 A * 3/1992 Retat ..... 244/171.9
5,451,202 A * 9/1995 Miller et al. ..... 602/36
5,484,388 A 1/1996 Bassett et al.

(Continued)

FOREIGN PATENT DOCUMENTS

EP 0482988 4/1992

(Continued)

OTHER PUBLICATIONS

Rubin, C. et al. "Mechanical Strain, Induced Noninvasively in the High-frequency Domain, Is Anabolic to Cancellous Bone, But Not Cortical Bone", Bone, 2002, 30(3):445-452.

(Continued)

*Primary Examiner*—Danton DeMille
(74) *Attorney, Agent, or Firm*—Thomas D. Wilhelm; Wilhelm Law, S.C.

(57) ABSTRACT

A device for non-invasively mechanically stimulating bone or muscle includes a vibrational energy generator for applying vibrational energy to a first end of a length of a tissue which includes bone and/or muscle. The vibrational energy is for inducing strain in at least one region within the length of tissue. A restraint is disposed opposite the first end of the length to resist translation of the length during operation of the device and to provide loading to the bone or muscle. A connecting structure couples the restraint to the vibrational energy generator. The device does not require gravity to operate and as a result is expected to have applications in space, such as with astronauts, with those having bone ailments such as bed-ridden patients, persons with osteoporosis or disuse atrophy, athletes, recovering bone cancer patients, and persons with muscoskeletal disorders.

16 Claims, 6 Drawing Sheets

U.S. PATENT DOCUMENTS 6,061,597 A 5/2000 Rieman et al.
6,106,490 A * 8/2000 Shaw ..... 601/49

FOREIGN PATENT DOCUMENTS

FR 2726184 5/1996

OTHER PUBLICATIONS

Qin, Y. et al. "Nonlinear Dependence of Loading Intensity and Cycle Number in the Maintenance of Bone Mass and Morphology", Journal of Orthopedic Research, 1998, 16:482-489.
Rubin, C. et al. "Low mechanical signals strengthen long bones", Nature, 2001, 412:603-604.

* cited by examiner

MUSCULOSKELETAL LOADING DEVICE

CROSS REFERENCE TO RELATED APPLICATION

The present application is a continuation of U.S. patent application Ser. No. 10/419,005, filed Apr. 18, 2003, which claims the benefit of U.S. provisional patent application No. 60/373,546 filed on Apr. 18, 2002, the entirety of which are incorporated herein by reference.

STATEMENT REGARDING FEDERALLY SPONSORED RESEARCH

This invention was made with United States Government support from the National Institute of Health through Grant No. 1R15HL67787-01. The United States Government has certain rights in this invention.

FIELD OF THE INVENTION

This invention relates generally to non-invasive musculoskeletal loading devices which provide adjustable loading.

BACKGROUND OF THE INVENTION

The health of human bones is of enormous importance. Bones provide support and protection for the human body. Osteoporosis is a disease characterized by low bone mass and structural deterioration of bone tissue which can seriously impede the ability of osteoporotic bones to provide support and protection for the body. An increased risk of bone fracture is present in individuals with osteoporosis. In 1995 alone, the cost of treatment for osteoporotic bone fractures was $13.8 billion. Around 28 million American's suffer from low bone mass or osteoporosis and are at risk of adding to the yearly cost of treatment for the disease. One in every 2 women and 1 in every 8 men over the age of 50 will develop a fracture in their lifetime due to the disease. With changing demographics and the aging of America, the significance of this national as well as international concern will only increase.

Bone disuse atrophy is a disease that can also lead to osteoporosis. While undergoing long flights in space, astronauts suffer from a lack of weight bearing on their bones. Bone disuse atrophy has been seen to cause decreases in bone mass from 1-2% per month in astronauts. Decreases in bone mass of this magnitude could seriously impede an astronaut's bone health during long duration space flight, such as what will someday be incurred by astronauts on roundtrip missions to Mars or other planets. With the closest medical assistance for an astronaut being millions of miles away, it is of key importance that an astronaut's bones do not degrade to a point where they risk fracture during missions.

The majority of current countermeasures for bone disuse atrophy are not entirely effective. Mineral and hormone treatments have been administered as attempts to maintain bone mass, but have had little benefit in the long run. Mechanical stimulation of bone has been shown to achieve the goal of maintaining bone mass and structure. However, some methods of applying mechanical stimuli may be more damaging than good, while others may only partially aid in the maintenance of bone strength.

Recent research involving the effects of vibrational bone loading have proved successful at increasing bone density in sheep. This and related research have utilized a vibrating platform upon which the sheep or other subject stands. Because this arrangement relies on gravity, the arrangement does not provide an adjustable load and loses its effectiveness as gravity is reduced.

SUMMARY

A device for non-invasively mechanically stimulating bone or muscle includes a vibrational energy generator for applying vibrational energy to a first end of a length of a tissue which includes bone and/or muscle. The vibrational energy is for inducing strain in at least one region within the length of tissue. A restraint is disposed opposite the first end of the length to resist translation of the tissue length or the device during operation of the device, and to provide compressive or tensile loading to the bone or muscle. The restraint can be disposed on a variety of bodily regions, including the knee, waist and shoulder.

A connecting structure couples the restraint across the tissue to be treated. The device does not require gravity to operate and as a result is expected to have applications in space, such as with astronauts, with those having bone ailments such as bed-ridden patients, persons with osteoporosis or disuse atrophy, athletes, recovering bone cancer patients, and persons with musculoskeletal disorders.

The level or frequency of the vibrational energy applied can be adjustable. The length of the connecting structure also can include structure for adjustment, wherein shortening the length provides compression and lengthening the length provides tension to the tissue region. The connecting structure can include a sensor for measuring a level of applied compression or tension.

The vibrational energy generator can comprises an adjustable cam driven by a motor. A speed controller is preferably provided and connected to the motor for controlling a speed of the motor. The arrangement provides an adjustable frequency spectrum output by the vibrational energy generator. The motor can drive a follower plate.

The connecting structure can comprises a plurality of structures which are each disposed circumferentially along a volume which includes the tissue length. The plurality of structures can be activateable independently, wherein activation of some but not all of the plurality of structures provides circumferential compression which varies as a function of angular position along at least a portion of the tissue length being treated.

A gravity-independent method for non-invasively mechanically stimulating bone or muscle, includes the steps of restraining a tissue region of a subject comprising at least one of bone and muscle, and applying vibrational energy through the region to induce strain in the region. The method can include the step of imposing a compressive or tensile force on the region during the applying step. The magnitude of the compressive or tensile force can be adjustable.

The method can be performed in a substantially weightless environment, such as space. The method can also be performed on earth, such as applied to supine subjects as no gravity is required to practice the claimed method.

The method can include the step of providing a vibrational energy generator, wherein a frequency spectrum provided by the vibrational energy generator is adjustable. The method can be applied to only a portion of the subject thus providing site-specific treatment. The frequency of vibrational energy can be 20, 30, 40, 50, 60 ,70, 80, 90, 100 Hz, or other frequencies.

BRIEF DESCRIPTION OF THE DRAWINGS

A fuller understanding of the present invention and the features and benefits thereof will be accomplished upon review of the following detailed description together with the accompanying drawings, in which:

FIG. 7 shows a restraint for use in connection with the bone loading device of FIG. 1.

FIG. 8 shows an alternative embodiment of a restraint for use in connection with the bone loading device of FIG. 1.

DETAILED DESCRIPTION OF THE INVENTION

Figure 1:
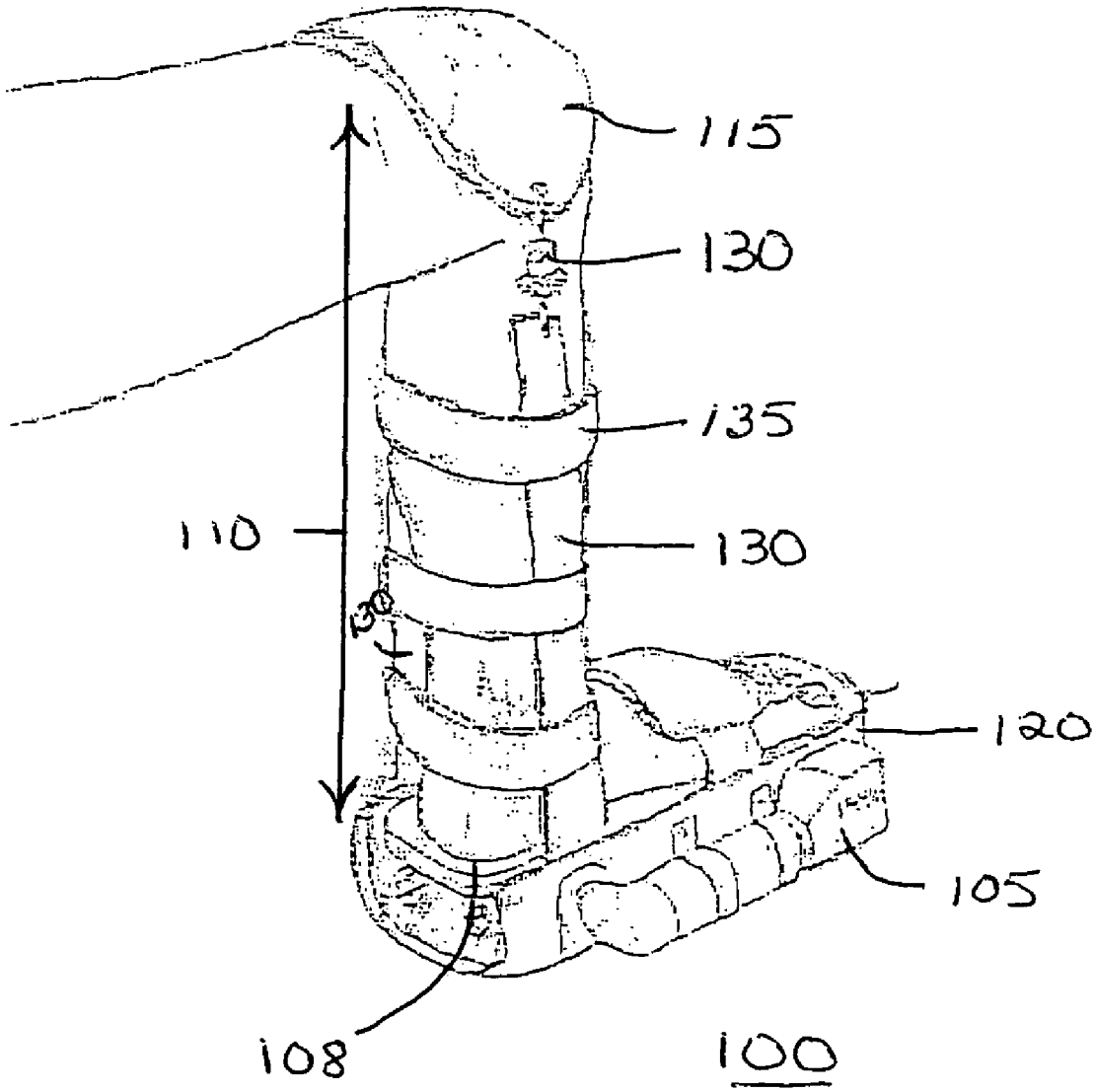
FIG. 1 illustrates an exemplary bone loading device, according to an embodiment of the invention.

FIG. 1 illustrates a device 100 for non-invasively mechanically stimulating bone or muscle in a subject, according to an embodiment of the invention. Device 100 can be used to mechanically stimulate an osteogenic effect in bone or the development of muscle. Device 100 includes a vibrational energy generator 105 for applying vibrational energy to a first end 108 of a length of a tissue to be treated 110 which includes bone and/or muscle therein (not shown). The vibrational energy is for inducing strain in at least one region within the length of the tissue 110.

A restraint 115 is disposed opposite the first end of the length 110 to resist translation of the length during operation of the device 100. Restraint 115 is coupled to connecting structure 130 which couples restraint 115 to the first end of the length of tissue to be treated, such as through connection to frame 120. Connecting structure 130 also provides a compressional coupling force and localized tensile forces to the region to be treated, the force preferably being adjustable, such as through variation of its length. Straps 135, such as Velcro® straps (or equivalent) are preferably provided for securing the connecting structure 130 to the length of tissue to be treated 110.

Unlike earlier vibrational loading devices, device 100 does not require gravity to operate and can be used in microgravity environments (e.g. space) or by supine (e.g. bedridden) individuals on earth. For vibrational treatment, bodily regions must have some coupling force (e.g. compression or tension) acting on them in order for the vibrational energy to transfer through the targeted region. On earth, a person capable of standing upright can utilize their body weight to provide the coupling force to permit vibrational energy to transfer through their body. However, for the gravity reliant systems while in space, when the first vibrational oscillation is applied, the subject would be sent adrift by the vibrational forces because no forces would be holding the vibration-inducing device to the person. In contrast, connecting structure 130, through its connection across of length of tissue to be treated 110, provides both a coupling and restraining force which does not depend on gravity.

Another advantage provided by device 100 is the ability to treat discrete portions (site-specific treatment) of a subject, rather than the entire subject treated when the individual stands on a vibrational plate. Thus, conventional vibrational loading devices gravitationally load the subject from head to toe, or from a seated position the spine of the subject is loaded. In contrast, device 100 can treat a single discrete tissue length, such as tissue length 110 disposed between the knee and the foot of an individual.

Although connecting structure 130 shown in FIG. 1 physically connects across the length of tissue to be treated 110 to provide a load, physical connection is not required. Loading can also be provided using an electromagnetic attractive force to induce compressive loading, such as using an electrical or magnetic field. For example, restraint 115 and a portion of frame 120 can each be electrodes which if biased with opposite polarities, will produce an attractive force which can provide a compressive load across tissue length 110.

Figure 2:
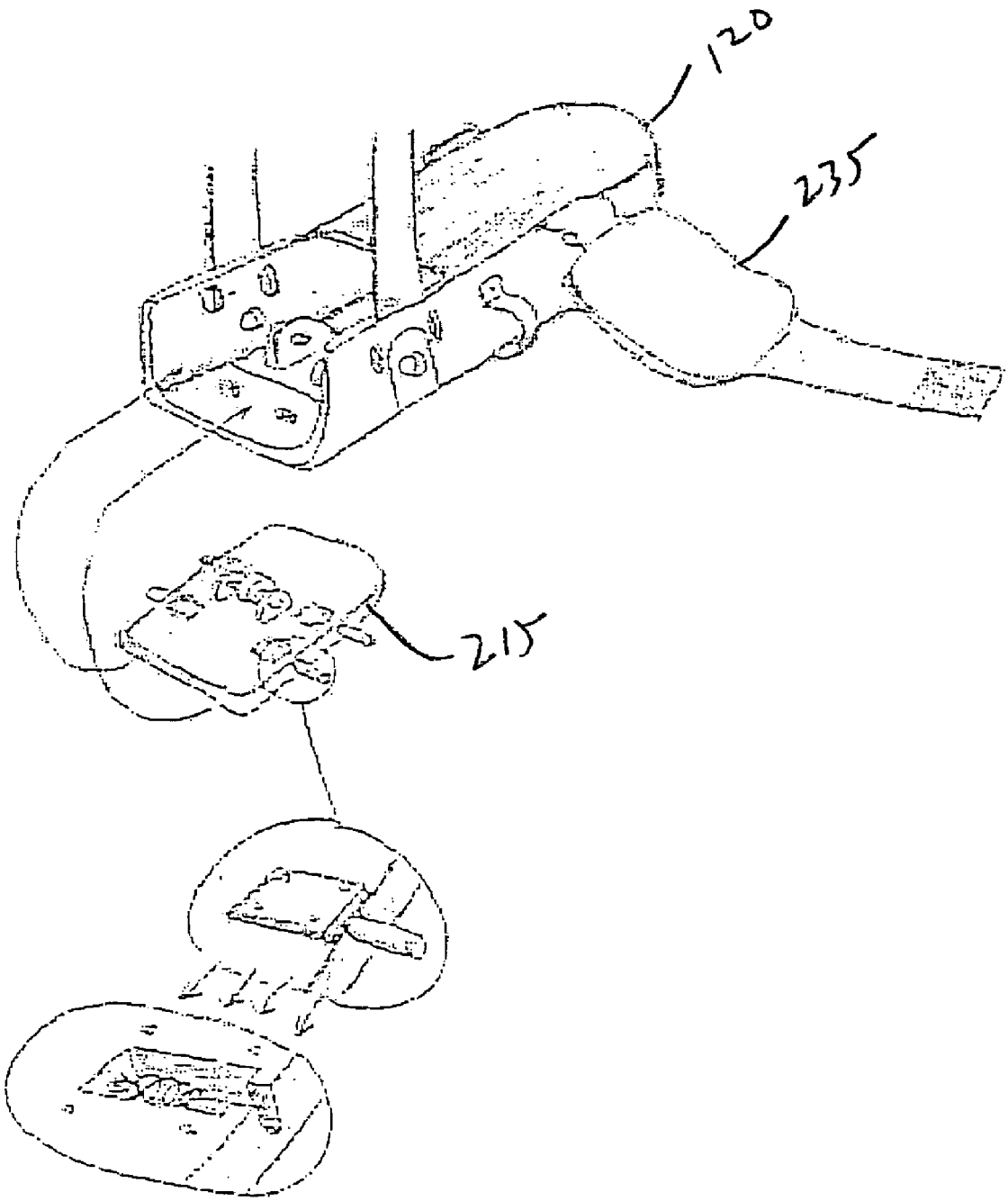
FIG. 2 shows an exemplary embodiment of a frame, according to an embodiment of the invention.

FIG. 2 shows an exemplary embodiment of frame 120 with vibrational energy generator 105 removed. Frame 120 includes a follower plate 215 upon which the first end 108 of a length of a tissue to be treated 110 is placed during operation of the device. However, those having ordinary skill in the art will realize that loading can be applied by structures other than follower plate 215. Optional strap 235 can be included to further secure the first end 108 of a length of a tissue to be treated 110 to frame 120. In operation, follower plate 215 is vibrated up and down by a suitable driving structure.

Figure 3:
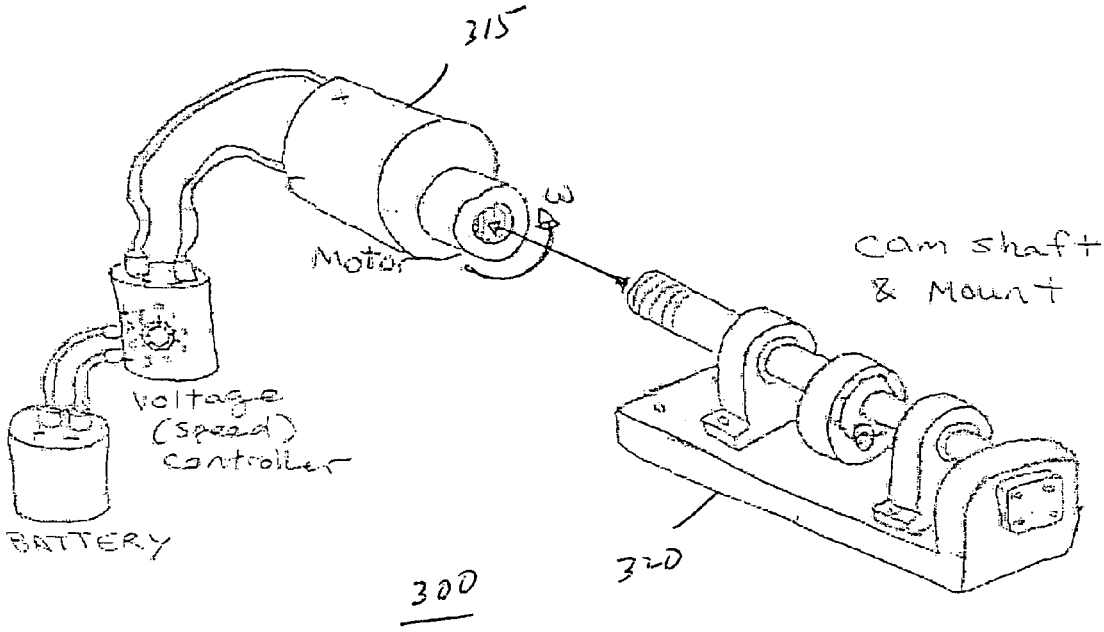
FIG. 3 shows a driving structure which comprises a motor to induce motion in a cam-follower which couples to a follower plate to apply vibrations to a subject, according to an embodiment of the invention.

In one embodiment shown in FIG. 3, vibrational energy to drive follower plate 215 can be produced via driving structure 300 which comprises a motor 315 to induce motion in a cam-follower 320 which couples to follower plate (not shown in FIG. 3). Although not shown, electromagnetic linear actuators and other vibrational energy sources can also be used with the invention. Applied to tissue 110 shown in FIG. 1, the mechanical vibrations at the follower plate will transfer the vibrations from the heel or ball of the subject's foot through tissue length 110.

Although described generally as for treating the region of tissue between the knee and the foot, the invention is in no way limited in this way. Those having ordinary skill in the art will realize a variety of other regions, such as the knee, waist, shoulder, arms and spine can be treated using device 100. In fact as illustrated in FIG. 7, a back restraint 700 with a lower back coupling pad 720, connecting structures 730, knee coupling pads 740 and leg pad 750 is shown as one example of a restraint for use in connection with the device 100. This embodiment of a restraint provides two non-invasive points of coupling at the back and the knees. To provide another alternative restraint for use in connection with device 100. FIG. 8 shows a waist restraint 800 having a waist restraint pad 820, connecting structures 830 and knee coupling pads 840.

Figure 4:
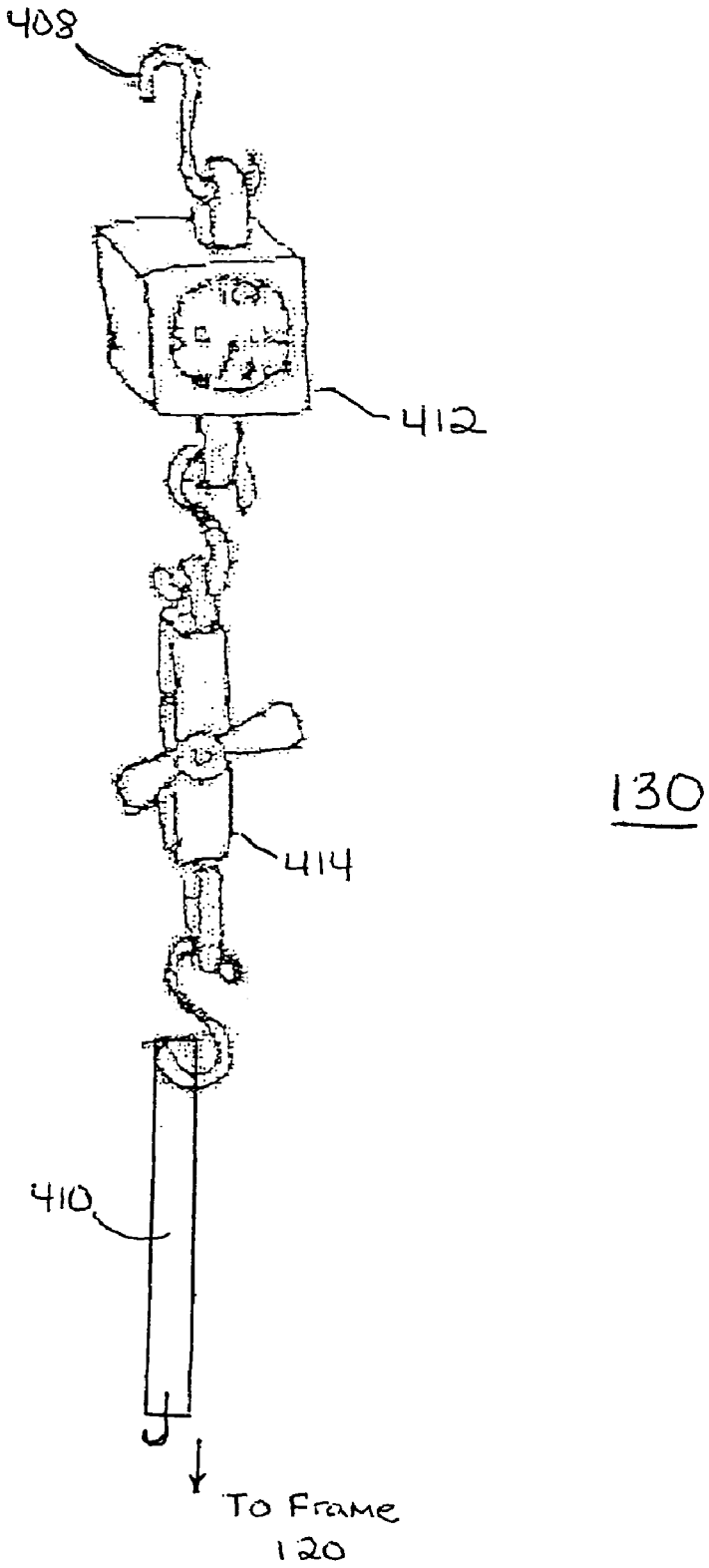
FIG. 4 shows an exemplary connecting structure, according to an embodiment of the invention.

FIG. 4 shows an exemplary connecting structure 130. Connecting structure 130 includes a fastener 408 to connect to restraint 115. Fastener 408 can be coupled to an optional force sensor 412. Force sensor 412 is shown coupled to adjustable knob 414 which is attached to a bar 410. Bar 410 connects to frame 120 (not shown). Adjustable knob 414 can increase or decrease the length of connecting structure 130 to provide adjustable levels of compressive or localized tensile loading. Although not shown, electronic controls can be integrated with connecting structure 130 to provide automatic coupling force adjustments.

Adjustability of device 100 is thus provided by connecting structure 130 shown in FIG. 4 as it is capable of providing a compressive or localized tensile force capable of variation. As used herein, the applied force is also referred to as a preload.

The preload, when present, acts on the targeted tissue region, such as a region of bone. A preload acting on the targeted bone region can be used to induce larger strains and to more effectively control the directions of strains in the bones or muscles of a subject as compared to applied vibrations alone.

Although not shown, device 100 can also include one or more strain gauges to monitor the strain induced along tissue length 110, such as disposed on the skin of a subject. Together with a conventional feedback and control system, the level of preload and/or vibrational energy parameters applied by vibrational energy generator 105 can be dynamically adjusted to provide a desired level of strain.

By providing larger strains to targeted tissue regions using preloads according to the invention, the time required for therapy to achieve a desired level of bone (or muscle) strengthening may be reduced. In particular, the addition of preloads acting on bones can produce larger strains at the midshaft of the diaphysis of long bones because of the curved shape of long bones. Thus, the use of preloads with the loading device 100 increases the efficacy of the process of increasing bone (or muscle) strength.

Figure 5A:
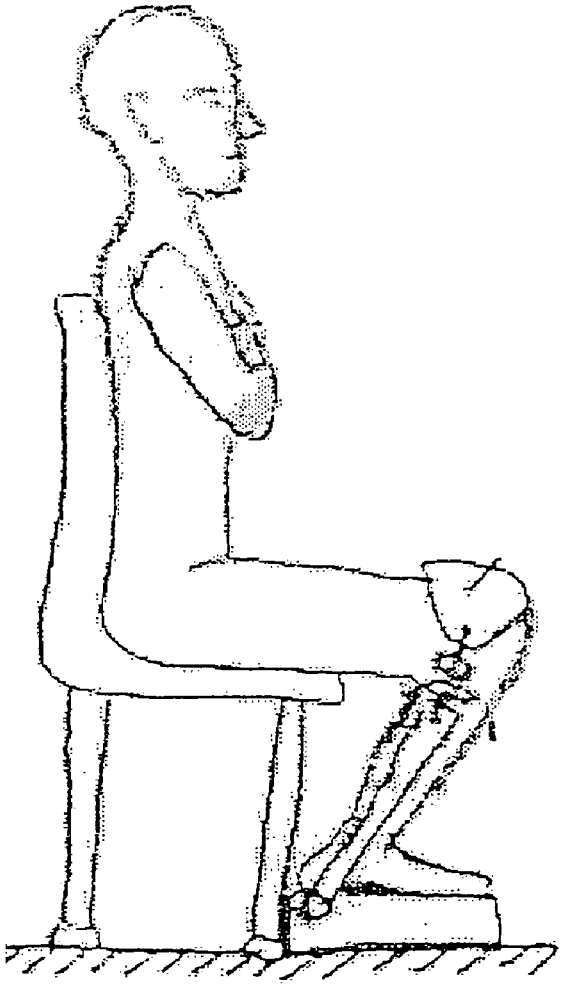
FIGS. 5(*a*) and (*b*) show therapy applied at two different knee angles using the invention.
Figure 5B:
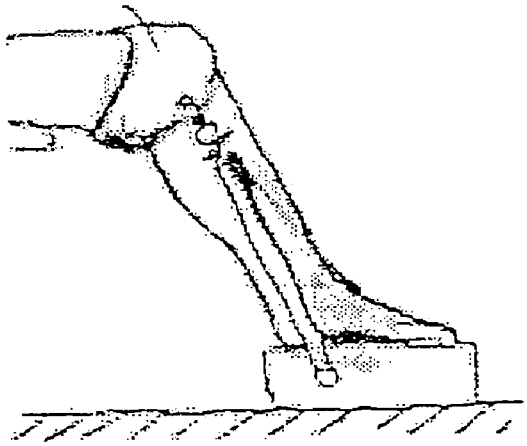

Further treatment adjustability provided by device 100 results from the ability to operate the device when the foot (or other tissue length) is flexed at different angles. FIGS. 5(*a*) and (*b*) show therapy applied using device 100 at two different knee angles. FIG. 5(*a*) shows a minimum muscle stretch on the posterior side of the lower leg, while FIG. 5(*b*) shows a maximum muscle stretch of the same region. The maximum muscle stretch shown in FIG. 5 (*b*) provides enhanced therapy in the calf region. An alternate embodiment includes active adjustment of the tissue length flexure during therapy to better simulate gravitational forces acting on the body during activities such as walking.

Figures 6A, 6B, 6C:
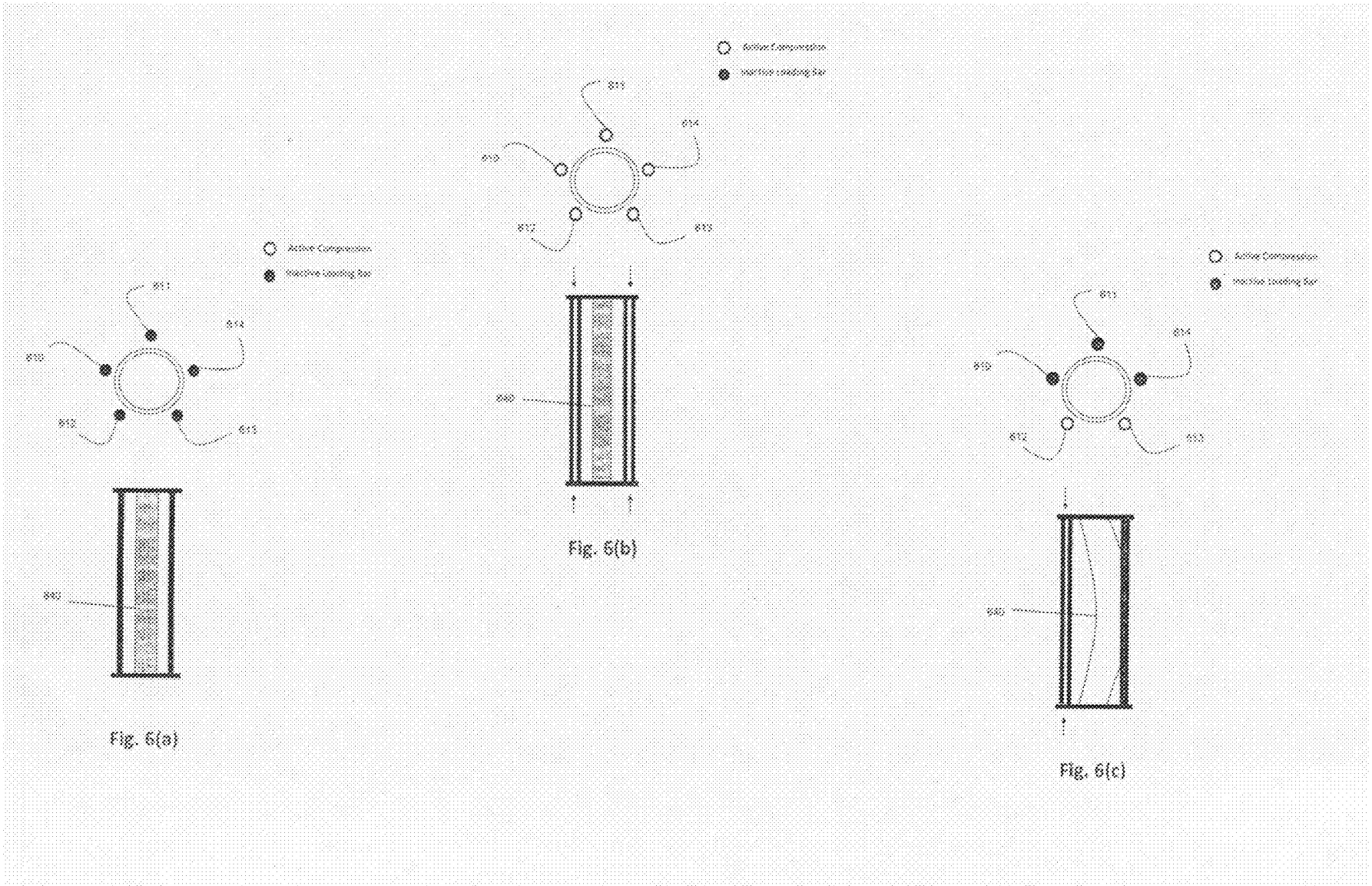
FIG. 6 shows an alternative connecting structure which comprises a plurality of separate compression-loading units, according to yet another embodiment of the invention.

In another embodiment of the invention, preloads can be directed through specific circumferential positions. FIGS. 6(*a*), 6(*b*), and 6(*c*) show connecting structure 600 adapted to provide preloads directed through specific circumferential positions. Rather than using two (2) connecting structures shown in FIG. 1, with each connecting structure covering only a small percentage of the circumference of tissue length 110, devices according to the invention can include a plurality of connecting structures which collectively cover an arc length spanning substantially the entire circumference of tissue length 110. This embodiment can induce equal or unequal stress or strain along the entire tissue length being treated.

For simplicity, FIG. 6 shows an alternate connecting structure 600, which comprises a plurality of separate connecting structures, referred to in this embodiment as force-loading units 610-614. Force-loading units 610-614 are placed circumferentially around a bodily region to be treated 640. Each force loading unit 610-614 is disposed between restraint 630 and frame 620 and preferably includes an adjustable knob or other structure (not shown) to independently increase or decrease their respective lengths to provide adjustable levels of compressive or localized tensile loading.

Loading units 610-614 can be activated one-by-one or in multiple succession to apply bending, tensile and/or compression loads to target bone (or muscle) regions 640. This permits key regions of bone to be strengthened as a function of angular position.

The top depictions in FIGS. 6(*a*)-(*c*) represent cross-sections of a long bone 640, while the pictures at the bottom show a lateral view of the same bone 640. FIG. 6(*a*) depicts bone 640 subject to no compressive load. FIG. 6(*b*) depicts bone 640 subject to uniform compression since all the compressional-loading units are actively providing the same level of compression. The arrows shown indicate the direction of loading. FIG. 6(*c*) depicts bone 640 subject to site-specific circumferential loading. Here, force-loading units 612 and 613 are actively applying compression, while force-loading units 610, 611 and 614 are inactive (not applying compression). Loading bone 640 as shown in FIG. 6(*c*) creates a bending moment about the bone, thus circumferentially influencing bone morphology.

This method of loading bone can be advantageous particularly when one side of a bone is weaker than another. The location where stresses in a bone are the highest generally are the sites where bone adaptations are most necessary, so that new bone will be deposited most readily. Therefore loading a bone such that bending is induced will allow new bone to be deposited more readily at the site where additional support is necessary.

By actively changing the circumferential loading direction during vibration-induced bone strengthening sessions, the bone 640 will be subjected to loading in multiple directions, which may prove advantageous to uniaxial loading (i.e., compression loading alone). Preferential stiffness of a bone loaded uniaxially can cause deleterious effects if the bone is later subjected to loading in shear. This is because the bone is only geared to absorb loading in the direction it has been "trained" to absorb loads in.

The invention has many potential uses. For example, U.S. Pat. No. 6,061,597 to Reiman et al discloses a method and device for healing bone fracture. The invention can likely be used to enhance the healing bone fracture through the coupling of vibrational energy through the region in healing. Thus, using the present invention, bone can experience increased mass, density, and structural strength, while muscle can experience increased strength, size, flexibility. Joints/ligaments/tendons can also benefit from the invention and receive increased flexibility. Skin toning is also possible using the invention.

While the preferred embodiments of the invention have been illustrated and described, it will be clear that the invention is not so limited. Numerous modifications, changes, variations, substitutions and equivalents will occur to those skilled in the art without departing from the spirit and scope of the present invention.

I claim:

1. A method for non-invasively stimulating a bone segment to be treated, the bone segment having a length, the method comprising applying a stimulating device to such bone segment, such method comprising:

(a) coupling a first restraint having a first perimeter, as part of a first part of the stimulating device, to the bone segment at a first location;

(b) coupling a second restraint having a second perimeter, as a second part of the stimulating device, to the bone segment at a second different location and in opposing relationship with the first restraint;

(c) connecting the first restraint and the second restraint to each other, using at least first, second, and third connectors, as parts of the stimulating device, the first, second, and third connectors being spaced about the first and second perimeters of the first and second restraints, and thus about a corresponding perimeter of such bone segment to be treated; and (d) applying vibrational energy to the stimulating device, thereby applying vibrational energy across such length of such bone segment.

2. A method as in claim 1 comprising spacing the connectors equally about the perimeters of the first and second restraints.

3. A method as in claim 1 comprising connecting the first restraint and the second restraint to each other using first, second, third, and fourth connectors.

4. A method in claim 1 comprising connecting the first restraint and the second restraint to each other using first, second, third, and fourth connectors.

5. A method in claim 1, further comprising varying speed of a motor and thereby creating a frequency spectrum in the stimulating device during ongoing operation of the stimulating device.

6. A method as in claim 1, further comprising dynamically adjusting tissue length flexure during such stimulating of such bone segment.

7. A method in aim 1, further comprising actively changing circumferential loading direction during such treatment of such bone segment.

8. A method in claim 1, further comprising adjusting the at least first, second, and third connectors In length, collectively, so as to apply unequal stress loading on such bone segment between the first and second restraints and accordingly creating a bending moment on such bone segment.

9. A device for non-invasively stimulating a bone segment to be treated, said device comprising:

(a) a first restraint, having a first perimeter, and being adapted and configured for connecting at a first location relative to such bone segment;

(b) a second restraint, having a second perimeter and being adapted and configured for connecting at a second different location relative to such bone segment in opposing relationship to said first restraint;

(c) a connecting structure coupling said first restraint to said second restraint, said connecting structure comprising at least first, second, and third connectors, spaced about the first and second perimeters of said first and second restraints, and thus about a corresponding perimeter of such bone segment to be treated, wherein said at least first, second, and third connectors can be adjusted in length independent of one another so as to apply unequal stress loading on such bone segment between said first and second restraints and accordingly to create a bending moment on such bone segment; and (d) a vibrational energy generator secured in said device, said vibrational energy generator being adapted and configured to apply vibrational energy across such length of such bone segment.

10. A device as in claim 9 wherein said connectors are equally spaced about the perimeters of said first and second restraints.

11. A device as in claim 10, further comprising a fourth connector connecting said first and second restraints.

12. A device as in claim 11, further comprising a fifth connector connecting said first and second restraints.

13. A device as in claim 9, further comprising length-adjusting elements which can be manipulated to increase and/or decrease the lengths of said connectors between said first and second restraints.

14. A device as in claim 9, further comprising a sensor which measures levels of tension in said connectors.

15. A device as in claim 9, further comprising a speed controller operative with said motor, controlling a speed of said motor, whereby a frequency spectrum provided by said vibrational energy generator is adjustable.

16. A device as in claim 9, said device spanning a length of such bone segment so as to include at least first and second joints in such bone segment.

* * * * *